US005180036A

United States Patent [19]

Boben

[11] Patent Number: 5,180,036

[45] **Date of Patent: * Jan. 19, 1993**

[54] CAM OPERATED RAIL CLAMPING DEVICE

[76] Inventor: Ronald J. Boben, 503 N. Ingleside, Fairhope, Ala. 36532

[ * ] Notice: The portion of the term of this patent subsequent to Sep. 10, 2008 has been disclaimed.

[21] Appl. No.: 752,086

[22] Filed: Aug. 29, 1991

Related U.S. Application Data

[63] Continuation-in-part of Ser. No. 582,669, Sep. 14, 1990, Pat. No. 5,046,588.

[51] Int. Cl.[5] ..... F16D 66/00; B61H 7/12; B61K 7/16

[52] U.S. Cl. ..... 188/1.11; 188/43; 188/60

[58] Field of Search ..... 188/41–44, 188/62, 63, 67, 1.11; 212/110, 122; 246/167 R, 167 A, 200 A, 200 B, 200.5, 201

[56] References Cited

U.S. PATENT DOCUMENTS

| | | | |
|---|---|---|---|
| 1,401,991 | 1/1922 | Lehr | 188/67 |
| 2,727,593 | 12/1955 | Vicklun | 188/43 |
| 3,604,865 | 9/1971 | Bricker | 188/1.11 X |
| 3,759,189 | 9/1973 | Desilets | 188/43 X |
| 3,998,166 | 12/1976 | Morrison | 188/41 X |
| 4,007,815 | 2/1977 | Acre | 188/67 X |
| 4,275,659 | 6/1981 | Theurer et al. | 104/2 |
| 4,365,777 | 12/1982 | Geiger | 246/34 CT |
| 4,679,645 | 7/1987 | Galloway et al. | 188/1.11 X |
| 5,046,588 | 9/1991 | Boben | 188/41 |

*Primary Examiner*—Robert J. Oberleitner
*Assistant Examiner*—Alfred Muratori
*Attorney, Agent, or Firm*—George A. Bode

[57] ABSTRACT

This invention is a cam operated rail clamping device for preventing movement of a structure on a rail comprising a base, a vertically disposed post secured to and projecting upwardly from the base, a tube rotatably and slidably mounted on the post, an air (or hydraulically) operated lift cylinder for raising the tube, a vertically disposed beam extending upwardly from the base and secured thereto, a horizontally disposed flange secured to the lower end of the tube, a clamping jaw carried by the flange and provided with a high point and a plurality of teeth for engagement with a first side of a rail, the flange being mounted for rotation about the post to bring the high point of the jaw into wedging action with the first side of the rail when the flange engages a top portion of the rail, a wearing shoe carried by the base for engagement with a second side of the rail, and a microswitch for indicating the position of the clamping jaw.

9 Claims, 6 Drawing Sheets

CAM OPERATED RAIL CLAMPING DEVICE

This application is a continuation-in-part application of a previous application by the same inventor bearing U.S. Ser. No. 07/582,669 filed Sep. 14, 1990 (now U.S. Pat. No. 5,046,588 issued Sep. 10, 1991). The entire previous application Ser. No. 07/582,669 is incorporated herein by reference as if set forth in full below.

BACKGROUND OF THE INVENTION

1. Field of the Invention

The apparatus of the present invention relates to a rail brake or rail clamping device for fastening a structure to rails, and more particularly, to a cam operated device that clamps a structure to a rail to prevent movement of the structure along the rail.

The present invention is designed to be used on movable bridges, cranes, stackers, reclaimers and other structures that move along rails.

2. General Background

Patents present in the art are: U.S. Pat. No. 648,258 issued to Hill; U.S. Pat. No. 1,236,315 issued to Kelly; U.S. Pat. No. 1,401,991 issued to Lehr; U.S. Pat. No. 1,513,296 issued to Thorne; U.S. Pat. No. 1,548,876 issued to Fischer; U.S. Pat. No. 2,172,627 issued to Snow; U.S. Pat. No. 2,189,244 issued to Gilbert; U.S. Pat. No. 2,369,513 issued to Zahodiakin; U.S. Pat. No. 2,727,593 entitled "Rail Clamp"; U.S. Pat. No. 4,007,815 entitled "Releasable Lock For Brakes"; U.S. Pat. No. 3,759,189 entitled "Anti-Back-Up Device For Work Carriers On Power-And-Free Conveyor Systems"; U.S. Pat. No. 4,262,811 entitled "Log Carrier"; German (BDR) Patent No. 1 481 776; USSR Patent No. 261442; and, Japanese App. No. 52-66115; all of which are directed to braking or clamping devices, but do not meet the needs of the device of the present invention.

SUMMARY OF THE PRESENT INVENTION

The preferred embodiment of the apparatus of the present invention solves the problems of slippage and indicating the same in a straightforward and simple manner. What is provided is a cam operated rail clamping device comprising a base, a vertically disposed post projecting upwardly from the base and secured thereto, a tubular member rotatably and slidably mounted on the post, an air or hydraulically operated lift cylinder for raising said tubular member, a vertically disposed beam extending upwardly from the base and secured thereto, a horizontally disposed flange secured to the lower end of the tubular member, a clamping jaw carried by the flange and provided with a high point and a plurality of teeth for engagement with a first side of a rail, a wearing shoe carried by the base for engagement with a second side of the rail, the flange being mounted for rotation about the post to bring the high point of the jaw into wedging action with the first side of the rail when the flange engages the top of the rail, a set of microswitches for positioning the clamping jaw, and clamping jaw position indicator.

In view of the above, it is an object of the present invention to provide for the positive clamping action of a structure to a rail in order to prevent the unintentional movement of the structure along the rail.

Another object of this invention is to provide a clamping device for fastening any type of structure in place that moves along steel rails and wherein the structure will be secured in place even though the rails are wet, icy, oily or greasy. The clamping device is simple to operate and requires little maintenance; the clamp frame rides on top of the rail to clean the rail of any obstructions such as ice, snow, cargo or debris.

Another object of the present invention is to provide means for indicating the direction of movement of the structure along the rail.

A further objective of this invention is that it be simple in nature and inexpensive to maintain and manufacture.

Other objectives and advantages will be apparent during the course of the following description.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
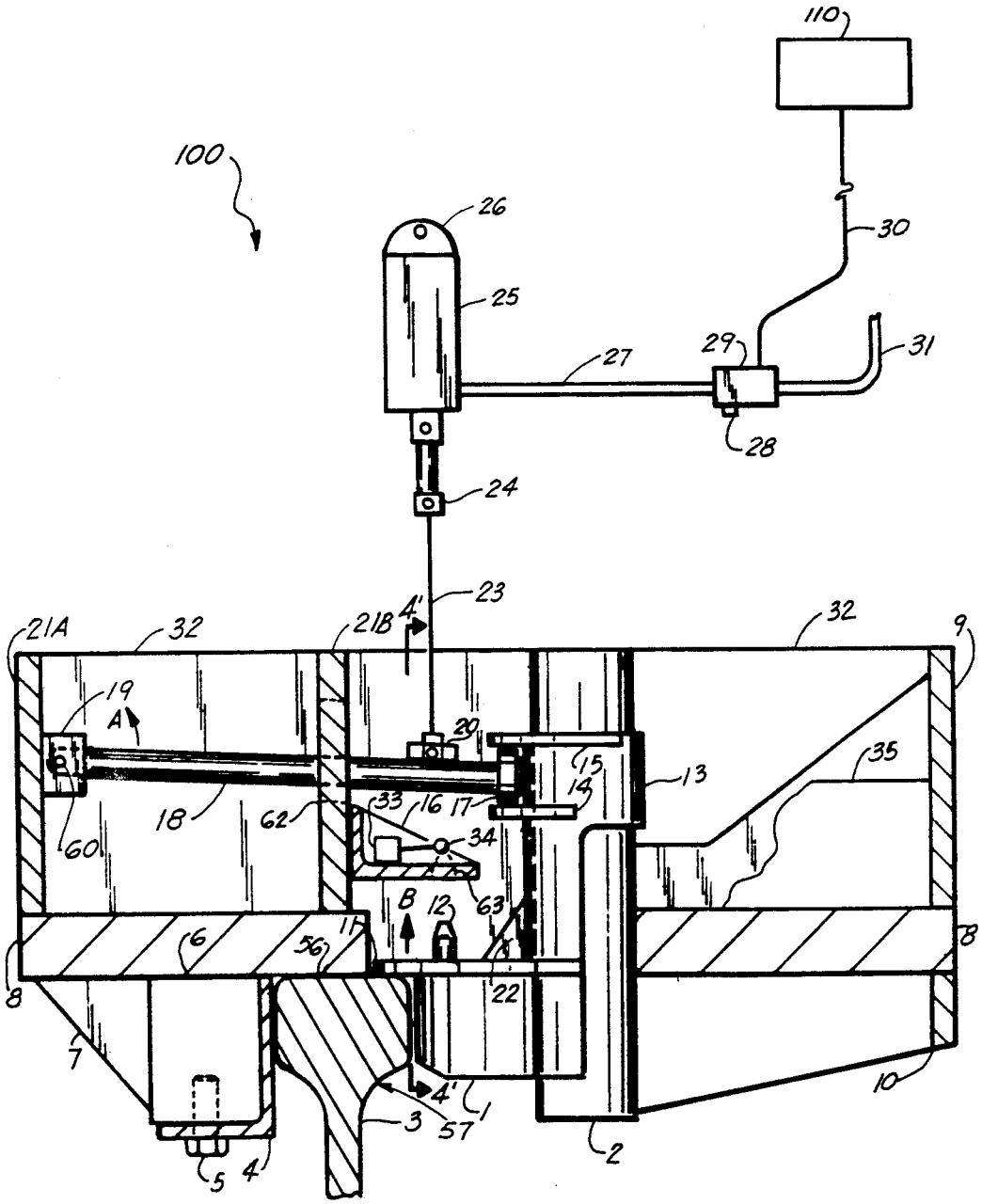
FIG. 1 is a side or end elevational view of the rail clamp of the preferred embodiment of the present invention, partially broken away; also included is a view of an air-operated lift mechanism.
Figure 1A:
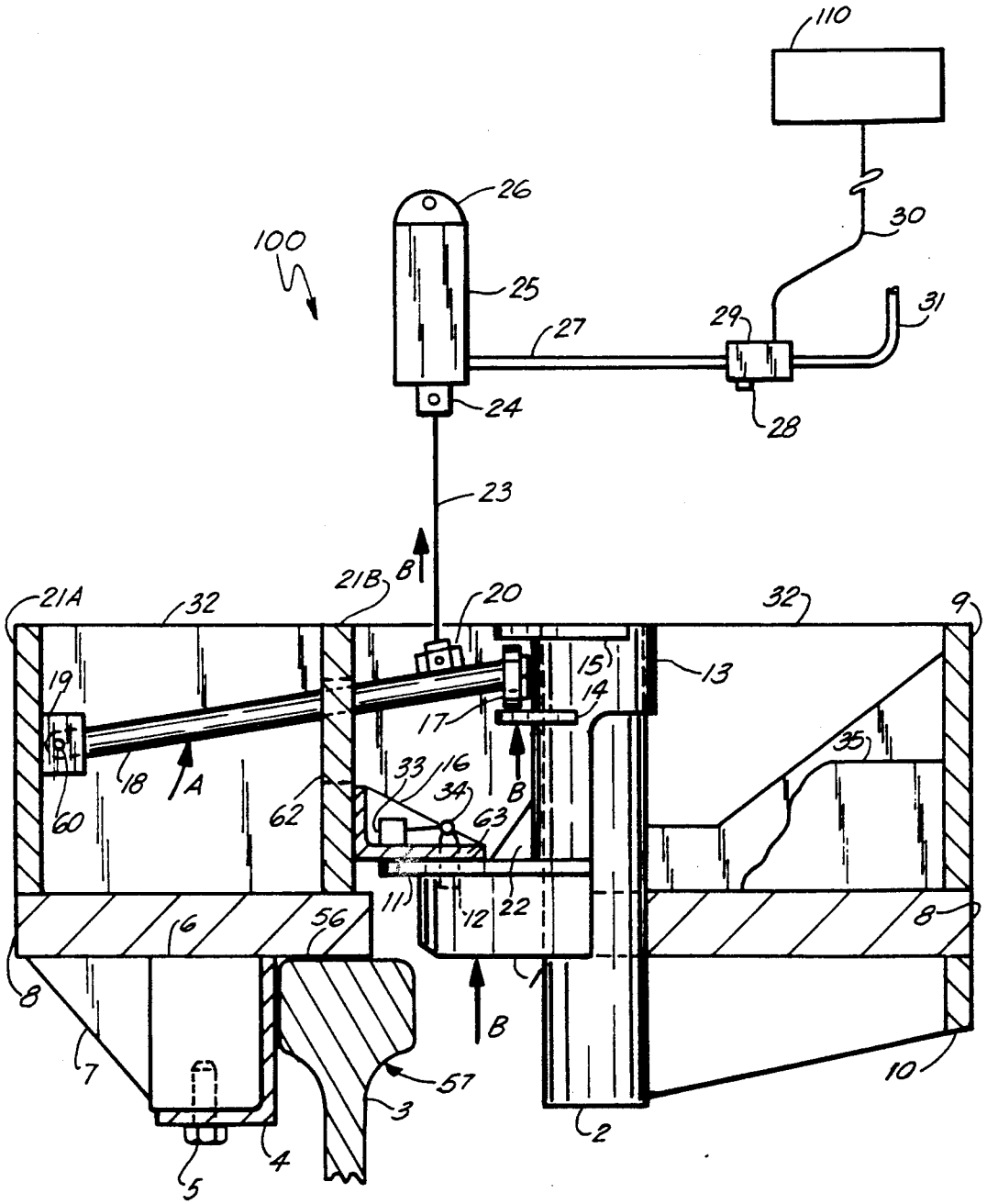
FIG. 1A is the side elevational view of FIG. 1, but with the lifting arm and cam in the raised or up (neutral) position.
Figure 2:
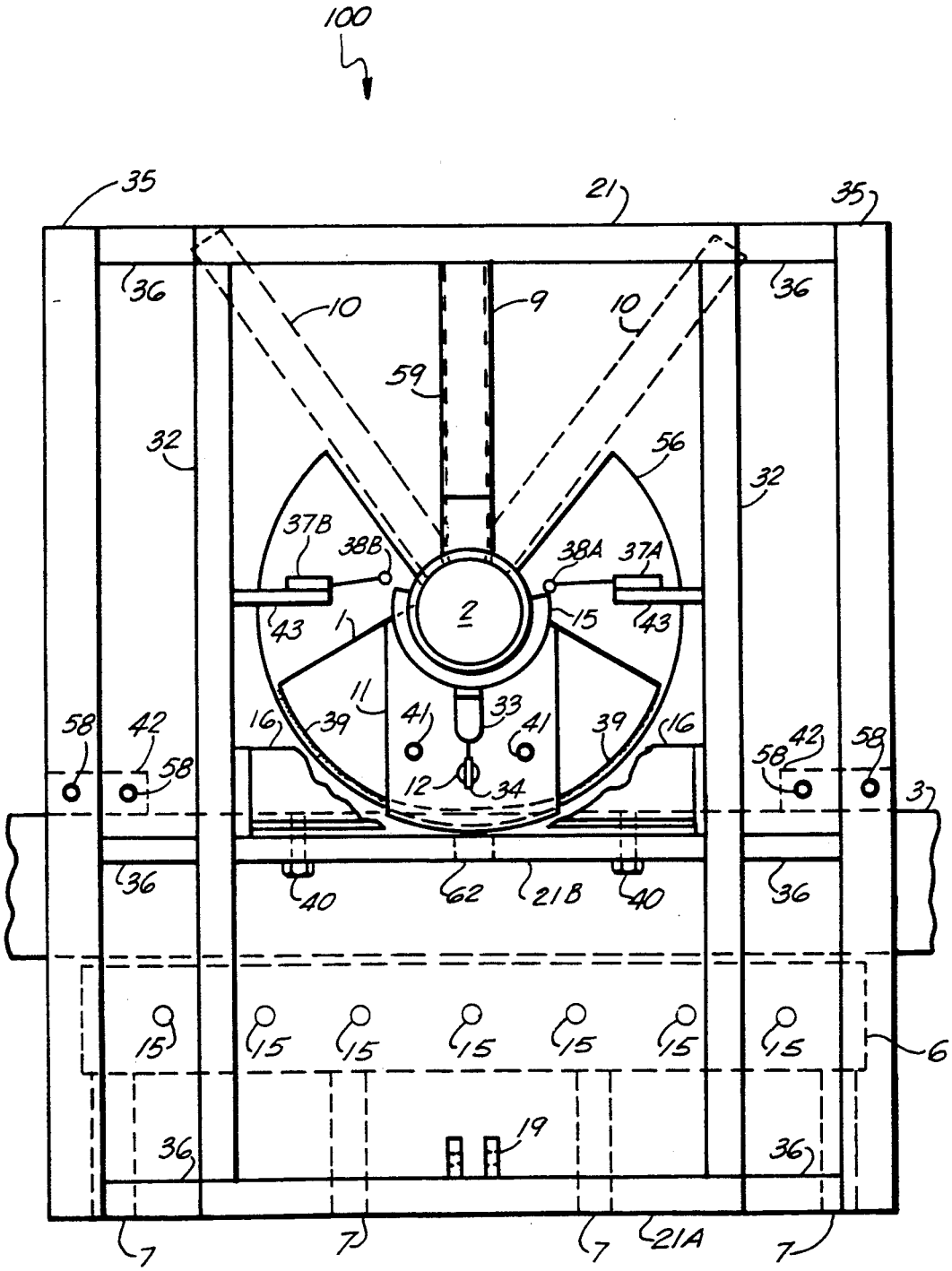
FIG. 2 is a top plan view of the rail clamp, partially broken away.
Figure 2A:
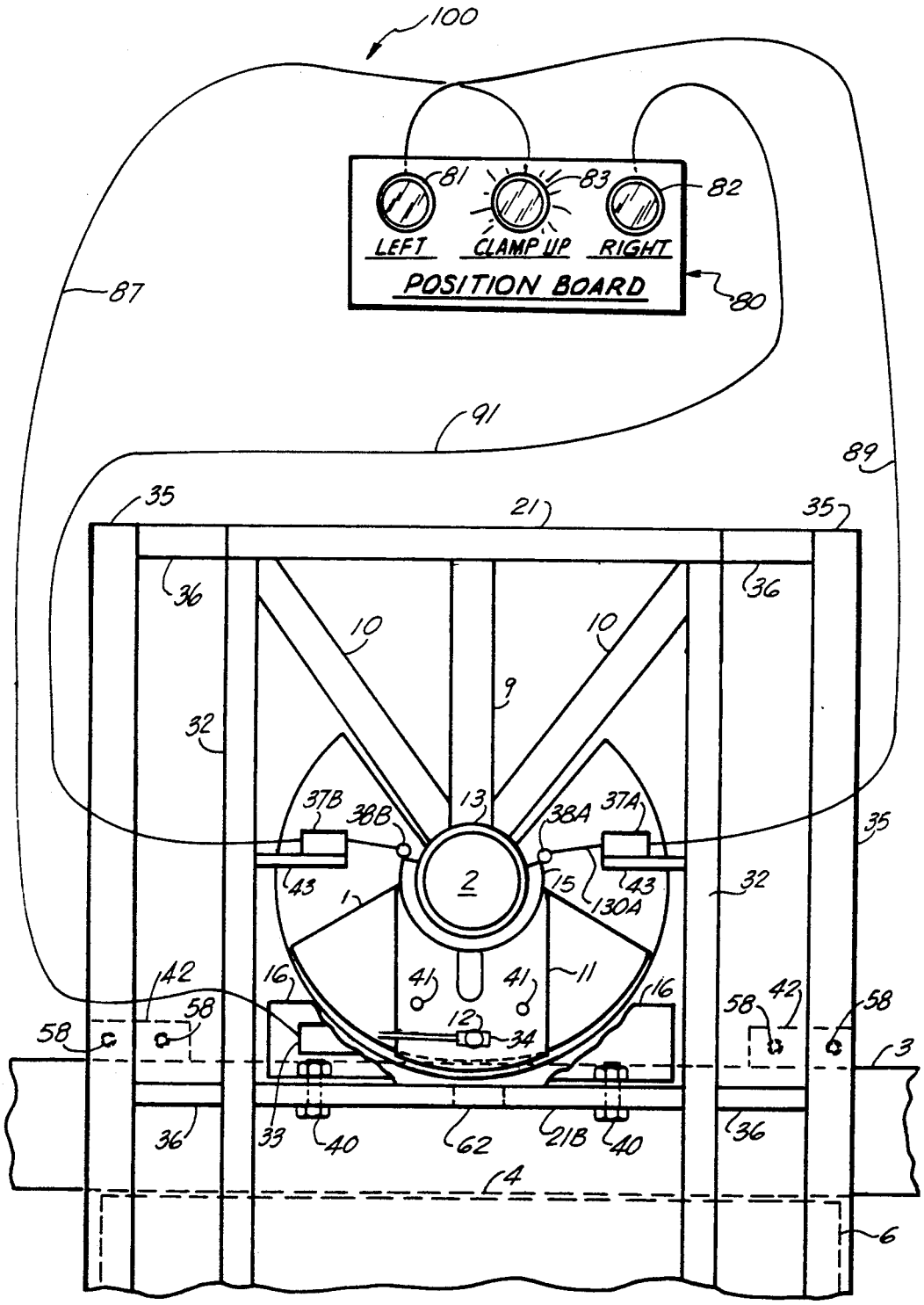
FIG. 2A is the top plan view of FIG. 2, but with the cam in the raised or up (neutral) position and connected to the indicating panel.

Referring now to the drawing, and in particular FIGS. 1, 1A, 2, 2A and 4, the preferred embodiment of the apparatus of the present invention is designated generally by the numeral 100. Rail clamp 100 comprises base 8 which can be made of any suitable material, and which is provided with a cutout 56 for receiving therein a rail 3 (having concave portion 57), as best seen in FIGS. 1 and 1A. The rail 3 may form part of a track and the cutout 56 in the base 8 defines a vertical wall 6. Arranged contiguously to the wall 6 is a wearing shoe 4. As best seen in FIGS. 2 and 2A, for maintaining shoe 4 in place, a pair of clamping bars 42, preferably round bars, are provided and these clamping bars 42 may be secured to the base 8 by suitable securing elements such as bolts or screws 58. The wearing shoe 4 is adapted to contact one side of the rail 3.

Projecting upwardly from the top of base 8 and secured thereto is a pair of vertically disposed spaced parallel ribs 32. There is further provided on the top of base 8, three plates 21 which are at right angles to ribs 32 for the purpose of reinforcing ribs 32 and providing a backup structure for gussets 36. Also projecting from the top of the base plate 8 are two bumper bars 35. Their purpose will be described later. Bumper bars 35, gussets 36, ribs 32, reinforcing plates 21 and base 8 are all secured to each other in any suitable manner, as for example by welding, and are best seen in FIGS. 1, 1A, 2, 2A and 4.

Projecting through and upwardly from the top of base 8 and fixedly secured thereto, is pivot pin 2; upper back up structure 9 which is secured by any suitable means, such as welding, to base 8; and reinforcing plate 21, as best shown in FIGS. 1, 1A, 2 and 2A.

Figure 3:
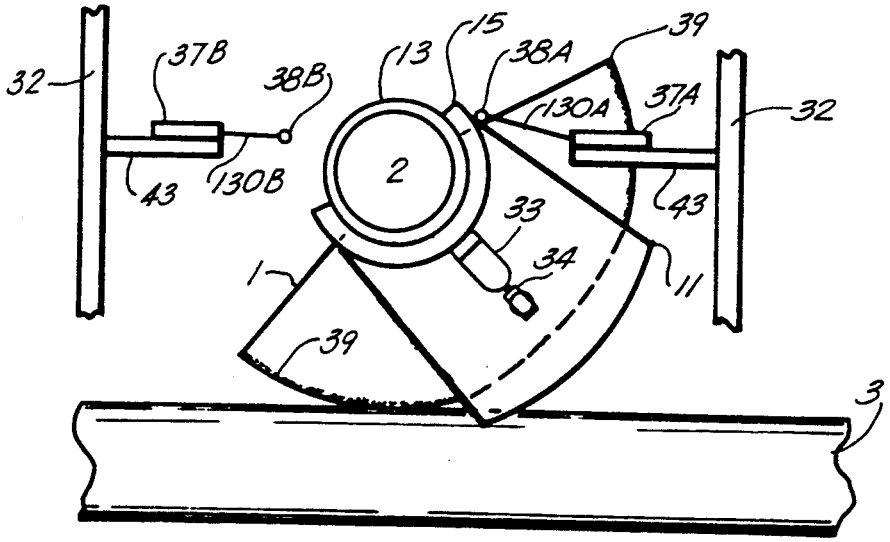
FIG. 3 is a fragmentary top plan view of the cam of the rail clamp, and, showing the cam in contact with the rail.

Projecting downwardly from the lower surface of base 8 are a pair of convergent plates or ribs 10 which meet at a point on pin 2, and a lower backup structure 59, positioned between the plates 10. Extending vertically through the structure is pin 2 which is secured by a suitable means, such as welding, to base 8; upper backup structure 9; lower backup structure 59 and the two convergent ribs 10. The post or pin 2 is stationary and provides a support or guide for the rotatable and vertically shiftable tubular member 13. A horizontally disposed flange 11 is secured to the lower end of the tubular member 13, as best seen in FIGS. 1 and 1A. The purpose of the flange 11 is to impart rotational motion to cam 1 during movement of the clamp by reason of the friction between the flange 11 and the top of the rail 3. The cam or eccentrically pivoted clamping jaw 1 is secured to the under surface of the flange 11 in any suitable manner, as per sample bolts 41. Cam 1 is mounted for rotational or swinging movement through an arc, and cam 1 is movable, mounted in a recess or cutout 56 in base 8. Cam 1 is provided with a plurality of serrations or teeth 39 which are arranged on the opposite side of rail 3 from wearing shoe 4. The top of tube 13, at which point lift flange 15 and guild flange 14 are secured by a suitable means, as for example welding, are used to provide a rotatable device for lifting cam 1 clear of rail 3. This will be described in more detail hereinafter. Lift flange 15 also provides a contact point for cam 1 and positioning microswitches 37, as best seen in FIGS. 2, 2A and 3; their function will be explained hereinafter.

Attached to flange 11 by any suitable means, such as welding, is gusset 22 which keeps tubular member 13 and cam 1 in proper alignment.

Figure 5:
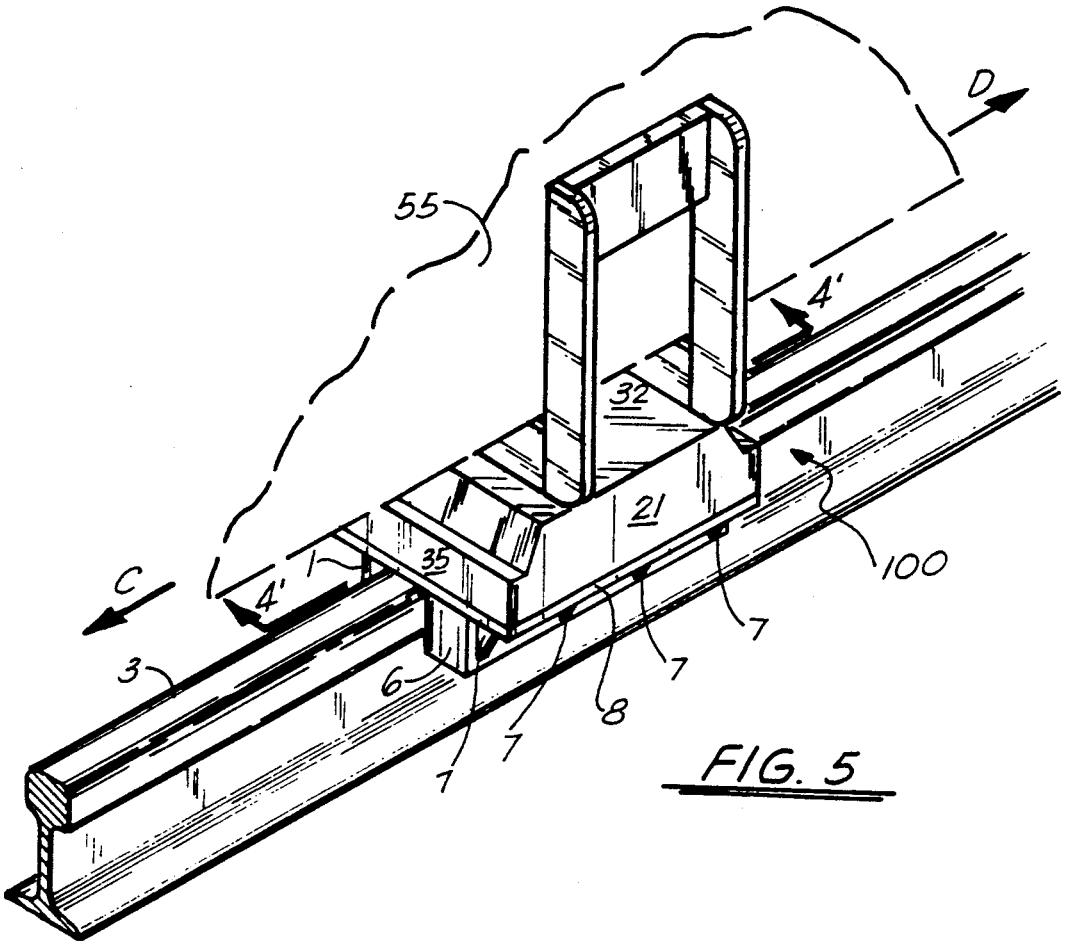
FIG. 5 is a perspective view of the embodiment of FIGS. 1–4 and illustrated as being mounted on a structure and secured to a rail.

Secured to base 8 in any suitable manner, as for example by welding, is a pair of bumper bars 35. These bumpers 35 are adapted to be engaged by a projecting portion 52 of the structure which may be a movable bridge, crane, stacker, reclaimer or the like that is to be held immobile or stationary on rails 3, as best seen in FIGS. 4 and 5.

The numeral 56 indicates the top wall surface of the vertical wall 6 which is lined with shoe 4. Vertical wall 6 is secured to base 8 by any suitable means, such as welding, and is provided with gussets 7 which are secured to base 8 and vertical wall 6 by means of welding, as best seen in FIGS. 1, 2 and 4. Surface 56 cooperates with shoe 4 and guild bars 42 to hold device 100 in proper position with respect to rail 3 and also serves to remove foreign matter from rail 3 upon movement therealong.

Referring now to FIGS. 1 and 1A, there is provided rail clamping device 100 which includes an air-operated cylinder 25 for elevating cam 1. Cam 1 is lifted by means of air from a source 31 entering cylinder 25 by line 27 forcing the piston up, thus giving upward movement to arm 18 transmitted through cable 23. Cable 23 is attached to arm 18 at pivot point 20 and cylinder 25 by means of clevis 24 on either end of cable 23. Arm 18 is secured to end bracket 21A by any suitable means, such as pin 60 and bracket 19 and continues through center bracket 21B by means of cutout 62 to rest on lifting flange 15. Roller 17 on the free moving end of arm 18 will come in contact with flange 15, lifting cam 1 to the raised position, through tubular member 13 when upward force is applied by cylinder 25.

Figure 4:
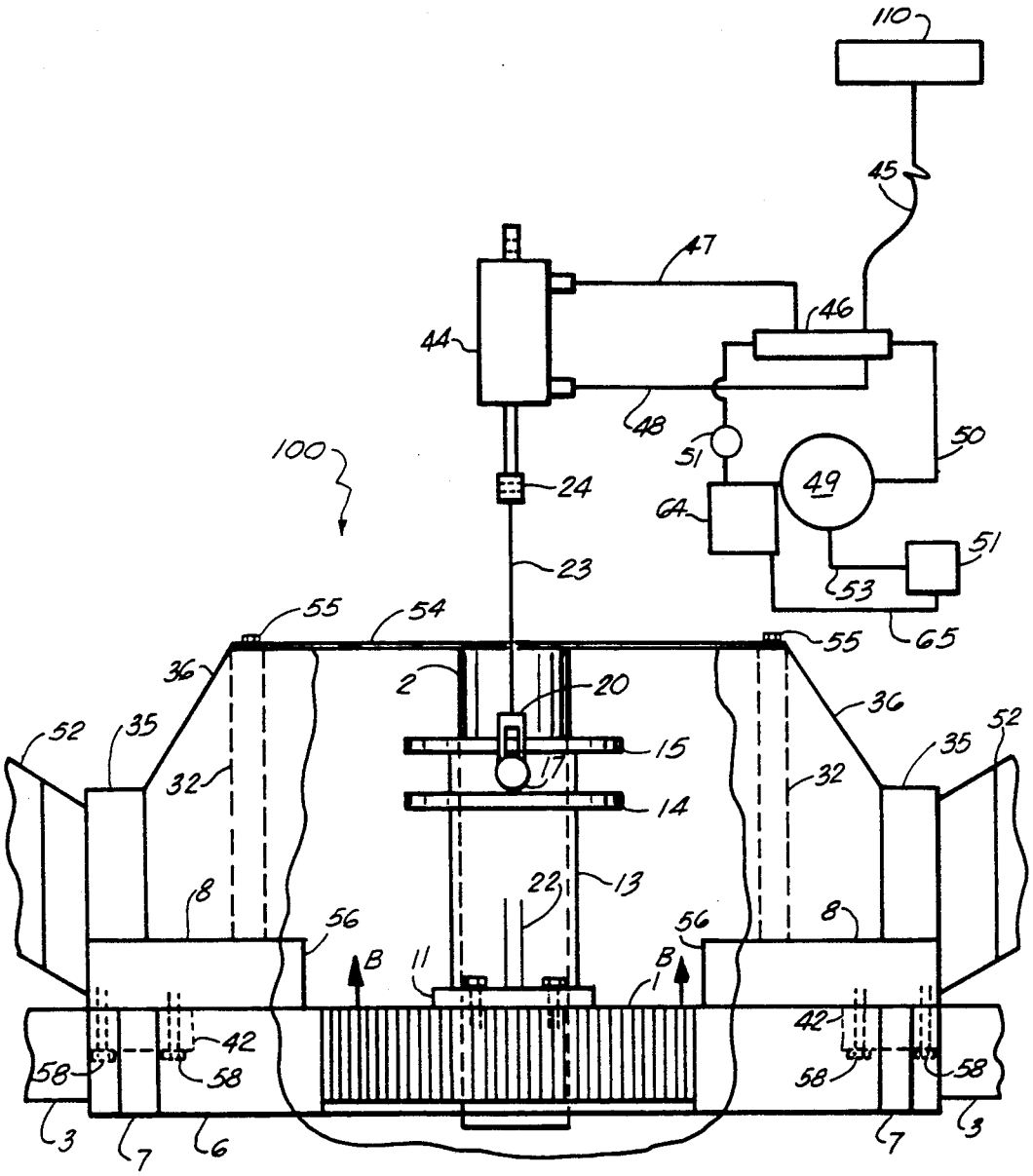
FIG. 4 is a view taken at right angles to the view shown in FIG. 1 and partially broken away and in section along Line 4'—4' of FIGS. 1 and 5; and, with the alternate means for raising the cam.

Cam 1 will be lowered into the clamping position of FIGS. 1, 2 and 4 when there is a loss of power from altimeter 110 through electrical supply cable 30. The air valve 29 and its operation will be described further hereinafter.

FIG. 4 shows arm 18 providing lift to cam 1 by an alternate means, that is by means of a hydraulic cylinder 44 which obtains its force from pump 51 which charges an accumulator 49. Oil enters cylinder 44 through line 48 from control valve 46 and pushes up on a piston (not shown) in cylinder 44, raising cam 1 in the same manner as was described in air operated cylinder 25, in FIG. 1. A more detailed description of the hydraulic operation will be discussed further hereinafter.

Referring now to FIGS. 1, 1A, a dual purpose centering and stopping bracket 16, which can be secured by any suitable means, is attached to the center brace 21B. FIG. 1 shows a pin 12 carried by plate 11. Pin 12 is adapted to project through an aperture or opening 63 in flange 16 when flange 11 is in its raised position of FIG. 1A. Thus, when the pin 12 projects in the opening 63, rotation of cam 1 is prevented, so that cam 1 cannot move into locking engagement with the side of rail 3 opposite from wearing shoe 4. As best seen in FIG. 1A and 2A, once cam 1 is in the upward position and pin 12 has projected through opening 63, pin 12 will come in contact with roller 34 pushing up on microswitch 33's arm 18, sending a signal by any suitable electrical source (as line 87 of FIG. 2A) to the control console 80 of the moveable structure, thus indicating, at visual indicator 83, to the moveable structure operator that cam 1 is raised in the proper upward position. This will be discussed further hereinbelow.

Referring now to FIGS. 1, 1A and 4, FIG. 1 best shows air operated cylinder 25 and FIG. 4 the hydraulically operated cylinder 44 used for raising tubular member 13 and cam 1 above rail 3, as when device 10 is to be shifted to any location along rail 3. Upon activation of valve 29 or valve 46 by any suitable electrical source (as altimeter 110), cylinder 44 or cylinder 25 will raise tubular member 13 and cam 1 to its locked position of FIG. 1A and 2A. Thus, device 100 can now be moved along rail 3. In using the assembly shown in FIGS. 1, 2 and 4, the clamp is not applied when device 100 is to be moved along rail 3. Tubular member 13 and cam 1 are raised from the position of FIG. 1 to the position of FIG. 1A in the direction of ARROWS B, which can be done by any suitable means, such as an air operated cylinder 25 or hydraulically operated cylinder 44. When the brake is to be applied or a loss of electrical energy occurs for any reason, tubular member 13 and cam 1 will drop by gravity to the position of FIG. 1.

Then, upon any movement of the assembly, the teeth 39 of cam 1, having been put into position by flange 11, will engage one side of rail 3 while the wearing shoe 4 will engage the other side of rail 3. Thus, teeth 39 will cam or lock against the rail 3. Therefore, further movement of the device will be prevented so that a structure being held stationary, such as the structure 52 abutting one of the bumpers 35 in FIG. 4, will be maintained immobile in any desired position.

Tubular member 13 will rotate on post 2 and at the same time, one of the microswitch rollers 38A, 38B will come into contact with flange 15 and move arm 130A or 130B of microswitch 37A or 37B to indicate which side of cam 1 has come into contact with rail 3. This is best illustrated in FIG. 3.

Microswitches 37 are secured to plate 43, which are secured by any suitable means to rib 32 and the operator of the structure will be able to identify, by any suitable source, such as indicator lights 81, 82 in the control console 80, in which direction the structure 55 had accidental movement. Thus, the operator could center cam 1 by travelling the structure 55 in the opposite direction of the indicated accidental travel, putting cam 1 in position to be lifted if controlled movement of the structure is needed.

However, as best seen in FIG. 1, when valve 29 is relieved of electrical source 30, valve 29 cuts off air source from 31 to line 27. Thus, air cylinder 25 which is attached to the structure by clevis 26, is allowed to bleed off by valve 28 at a controlled rate allowing flange 11 to land on top of rail 3 with no further movement of the structure. Tube 13 and cam 1 could be lifted by arm 18, by any suitable electrical energy source such as source 30, to valve 29, which would allow air from source 31 to pass through valve 29 into line 27 pushing the piston in cylinder 25 upward.

As best seen in FIG. 4, the hydraulically operated cylinder 44 would have a duplicating function as the above procedure. If a suitable electrical source 45 (from altimeter 110) were to be no longer supplied, valve 46 would discontinue hydraulic pressure to line 48 and would allow line 47 to be pressurized, thus allowing tube 13 and cam 1 to fall by gravity into position.

Pump 51 would provide required hydraulic pressure to accumulator 49. This kinetic power would be stored in case of a complete loss of electrical energy on the structure. Hydraulic pressure 50 from accumulator 49 would go into valve 46; spent pressure would be returned to tank 64 from which pump 51 would get suction. Thus, to return cam 1 and tube 13 to a raised position, a suitable electrical source would have to be returned to line 45, which would divert hydraulic pressure to line 48, pulling in the upward direction on cable 23, raising tube 13 and cam 1. The use of the air cylinder 25 or the hydraulic cylinder 44 would increase the lift capacity of cam 1 and tube 13, and would also remove debris, snow, ice or cargo that may be resting on the top of cam 1.

As best seen in FIG. 1, pin or peg 12 is so arranged that when cam 1 is raised, pin 12 will enter aperture 63 and will lock cam 1 in the neutral position, which will be indicated by a suitable source such as one of indicator lights 81, 82 on control console 80, as a direct result of pin 12 coming in contact with microswitch 33 through roller 34. Cam 1 is maintained just high enough as to be always in a position to engage rail 3 upon a very short drop. The rail clamp 100 of the present invention can be used for securing movable structures such as movable bridges, cranes, stackers, reclaimers and the like so that these structures will not move uncontrollably or be displaced even though adverse weather conditions may arise such as high winds and the like. The apparatus of the present invention uses a double serrated cam 1 which is in direct contact with rail 3 and the assembly has great holding power so that movable structures that travel on rails can be secured in place. Cam 1 engages rail 3 over which the structure travels and cam 1 is serrated or provided with teeth 39 and is double acting. Also, cam 1 can be lifted and will rotate, and the structure to be secured in place may be any type of device such as a coal and ore unloading bridge and tower, stacker, reclaimer or crane that travels on rails although the clamp can be used with other structures. The rail clamp 100 of the present invention is intended primarily for the protection of movable structures and is confined between two struts 52 secured to the structure 55 to accommodate the rail clamp 100. The entire rail clamp assembly slides along rail 3 with cam 1 in a raised position ready to be dropped to clamp the structure.

Microswitches 37 react off of bracket 43 and through roller 38, thus helping to center cam 1 so that when it is lifted, it will move to a neutral position as the result of the inherent resiliency of the microswitches. The lifting devices, cylinder 25 or cylinder 44, provide for raising cam 1 above rail 3 when the structure is proceeding along rail 3 for performing its work and whenever the structure is at rest. Cam 1 is dropped to its lowered position as shown in FIG. 1 so that the flange 11 contacts the top of rail 3. Cam 1 stays in this position unless the structure is moved unintentionally, by bumping or by high winds to which these structures are very susceptible. In the act of moving, the struts 52 of the structure 55 move the clamp body along rail 3 and cam 1 rolls along rail 3 because of its contact with rail 3 through flange 11 and this brings the high side of cam 1 to bear against rail 3. This forces rail 3 against wearing shoe 4 and friction between wearing shoe 4 and rail 3 stops any further movement of the clamp along rail 3.

Clamping device 100 of the present invention is of simple construction and requires very little maintenance and will secure the structure in place even though conditions may be wet, frosty, or icy or even if rail 3 may be oily. When the structure is to be moved, cam 1 is raised to clear rail 3 and after the moving has been completed, cam 1 is lowered so that flange 11 rests on top of rail 3. Then, any movement of the structure along rail 3 will move the body of clamp 100 with it and cam 1 will engage rail 3 due to friction between flange 11 and rail 3. If the forces tending to move the structure are great enough, the serrations or teeth 39 on the hard face of cam 1 will impress themselves into the side of rail 3 with enough force to gear cam 1 to the side of rail 3. This cam 1, acting on one side of rail 3, forces rail 3 against wearing shoe 4 and the friction thus created will prevent any further movement of the clamping device 100 and structure 55 along rail 3. This cam 1 is double acting, since it stops travel in either direction on rail 3. Clamping device 100 can be operated manually by disconnecting clevis 24. Cam 1 and tube 13 can be lifted and clevis 24 hooked into an emergency stowage bracket located on the structure and with enough elevation to maintain cam 1 in the neutral position, or electrically, as best illustrated in FIGS. 1 and 4, and only has to be lifted a short distance to be disengaged from rail 3. Further, cam 1 is of a positive self-centering construction due to provision of microswitches 37, which will help guide flange 11 to rest on rail 3. Also, clamp frame or base 8 rides on top of rail 3 to clean the rail of any obstruction such as ice or snow and wearing shoe 4 on one side of rail 3. When clamp 100 has become locked to rail 3, it is released by reversing the travel of the structure. The direction needed to release the clamp will be indicated by a suitable source in the control console 80 as a direct result of which microswitch 37 has come into contact with flange 15. Also, in the same manner, microswitch 33 will give position indication in the control console 80, by visual indicator 80, that the structure is ready for movement or can be used to tie into the circuits so that the structure cannot be moved accidentally unless one of the microswitches 37 are engaged. At that time, an override would have to be energized in order to move the structure out of the locked cam 1 position.

FIGS. 1A and 2A illustrate cam 1 in the raised or neutral position and when line 30 is energized, cam 1 will maintain this position. Microswitch 33 thus activates indicator light 83 on the operator's console board 80 via line 87 of FIG. 2A. When cam 1 drops to the position of FIGS. 1 and 2 and structure 55 moves to the left (ARROW C in FIG. 5), indicator light 83 would deactivate and left indicator light 81 would be activated by microswitch 37A via line 89.

Similarly, if cam 1 drops and structure 55 moves to the right (ARROW D in FIG. 5), indicator light 80 (or 81) would deactivate and right indicator light 82 would be activated by microswitch 37B via line 91.

If there is provided more than one clamping device 100 on structure 55, then there could be provided a position indicating console 80 for each.

Thus, if the clamping device 100 were down and structure 55 moved accidentally to the left (ARROW C in FIG. 5), the operator would be able to move the structure 55 in the opposite direction with the aid of a system bypass. Once both left and right indicator lights 81, 82 were out on all consoles 80, he would then be able to energize the system through line 30 (or line 45) and raise all the cams 1. Then he could switch back to normal operation.

Cam or clamping jaw 1 in FIG. 4 is somewhat automatic since a loss of electrical energy to the valve 25 or valve 44 will allow arm 18 to drop (opposite ARROW A of FIG. 1), thus engaging the flange 11 with rail 3, whereby cam 1 is put in position to set or lock.

With the addition of microswitches 37, this invention will enable the structure operator to determine, for any specific period, if the structure, reclaimer, stacker, movable crane or bridge, has sustained any accidental movement. If any movement has occurred, the structure operator can manipulate the structure in the opposite direction, as indicated by microswitch 37. This simple procedure allows cam 1 to be placed in the centering position.

Microswitch 33 provides a fail safe action to inform the structure operator of the raised position of cam 1, insuring that the structure is available for willed movement.

Cylinders 25 and 44 provide a stronger lifting action of tube 13 and cam 1 through arm 18 than any other device currently known to applicant. Thus, regardless of the environment in which cam 1 and tube 13 have been exposed; rusted post 2, snow or ice buildup between tube 13 and post 2, the added weight of loss debris on top of cam 1; movement of cam 1 will be insured.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A cam operated rail clamping device for preventing movement of a structure on a rail, comprising:

(a) a base;

(b) a vertically disposed post secured to and projecting upwardly from said base;

(c) a tubular member rotatably and slidably mounted on said post;

(d) means for raising said tubular member;

(e) a vertically disposed beam extending upwardly from said base and secured thereto;

(f) a horizontally disposed flange secured to the lower end of said tubular member;

(g) a clamping jaw carried by said flange and provided with a high point and a plurality of teeth for engagement with a first side of said rail, said flange being mounted for rotation about said post to bring said high point of said jaw into wedging action with said first side of said rail when said flange engages a top portion of said rail;

(h) means carried by said base for engagement with a second side of said rail;

(i) means for positioning said clamping jaw in a lowered operative position and raised inoperative position; and, (j) means for indicating the rotational position of said clamping jaw about said post when said clamping jaw is in said lowered operative position, said means for indicating the rotational position of said clamping jaw comprises second and third indicator lamps, said second indicator lamp being energized when said structure moves in one direction on said rail and said third indicator lamp being energized when said structure moves in the opposite direction.

2. The device of claim 1, wherein said means for engagement with said second side of said rail is a wearing shoe.

3. The device of claim 1, wherein said clamping jaw is engaged by first lowering said means for positioning to said operative position adjacent said rail, whereby said clamping jaw is then rotated into initial engagement with said first side of said rail and whereby movement of said structure on said rail will then cause said clamping jaw to further rotate into a clamped position.

4. The device of claim 1, wherein said means for raising said tubular member includes a hydraulically operated lift cylinder.

5. The device of claim 1, wherein said means for raising said tubular member includes a pneumatically operated lift cylinder.

6. The device of claim 1, further comprising means for indicating the lowered and raised positions of said clamping jaw.

7. The device of claim 6, wherein said means for indicating the lowered and raised positions of said clamping jaw comprises a first indicator lamp, said lamp being energized when said clamping jaw is in said raised position and de-energized when said clamping jaw is in said lowered position.

8. A cam operated rail clamping device for preventing movement of a structure on a rail, comprising:

(a) a base;

(b) a vertically disposed post secured to and projecting upwardly from said base;

(c) a tubular member rotatably and slidably mounted on said post;

(d) means for raising said tubular member;

(e) a vertically disposed beam extending upwardly from said base and secured thereto;

(f) a horizontally disposed flange secured to the lower end of said tubular member;

(g) a clamping jaw carried by said flange and provided with a high point and a plurality of teeth for engagement with a first side of said rail, said flange being mounted for rotation about said post to bring said high point of said jaw into wedging action with said first side of said rail when said flange engages a top portion of said rail;

(h) means carried by said base for engagement with a second side of said rail;

(i) means for positioning said clamping jaw in a lowered operative position and raised inoperative position;

(j) means for indicating the rotational position of said clamping jaw about said post when said clamping jaw is in said lowered operative position, said means for indicating comprising second and third indicator lamps, said second indicator lamp being energized when said structure moves in one direction on said rail and said third indicator lamp being energized when said structure moves in the opposite direction; and, (k) means for indicating the lowered and raised positions of said clamping jaw.

9. The device of claim 8, wherein said means for indicating the lowered and raised positions of said clamping jaw comprises a first indicator lamp, said lamp being energized when said clamping jaw is in said raised position and de-energized when said clamping jaw is in said lowered position.

* * * * *